US005598640A

United States Patent [19]

Schepisi

[11] Patent Number: 5,598,640

[45] Date of Patent: Feb. 4, 1997

[54] HAND HELD BLOW DRYER HAVING AIRFLOW CONTROL MEANS

[76] Inventor: Natale Schepisi, 22 Tulip Tree La., Mamaroneck, N.Y. 10543

[21] Appl. No.: 576,592

[22] Filed: Dec. 21, 1995

[51] Int. Cl.[6] ..... H45D 20/00

[52] U.S. Cl. ..... 34/97; 34/96; 392/384

[58] Field of Search ..... 34/96, 97; 392/380, 392/383, 384, 385

[56] References Cited

U.S. PATENT DOCUMENTS

| | | | |
|---|---|---|---|
| 3,860,174 | 1/1975 | Cercone . | |
| 3,955,065 | 5/1976 | Chambon . | |
| 4,097,722 | 6/1978 | Soler et al. . | |
| 4,232,454 | 11/1980 | Springer . | |
| 4,525,623 | 6/1985 | Da Silva | 219/373 |
| 5,148,512 | 9/1992 | Owens | 392/383 |
| 5,157,757 | 10/1992 | McDougall . | |
| 5,467,540 | 11/1995 | Bastien | 34/97 |
| 5,507,103 | 4/1996 | Merritt | 34/97 |

*Primary Examiner*—Henry A. Bennett
*Assistant Examiner*—Dinnatia Doster
*Attorney, Agent, or Firm*—Oblon, Spivak, McClelland, Maier & Neustadt, P.C.

[57] ABSTRACT

A hand-held blow dryer includes a barrel having concentric inner and outer cylinders. The outer cylinder is slidably mounted on the inner cylinder. Each of the inner and outer cylinder comprise a plurality of holes. A deflecting mechanism is positioned at the barrel opening of the barrel, and an actuating mechanism is operationally associated with the outer cylinder and the deflecting mechanism. The hand-held blow dryer can be utilized in a first mode in which the holes of the inner and outer cylinders are not aligned to block air flow through the barrel surface and thereby direct air to the barrel opening which is opened. In a second mode, the actuating mechanism is actuated so as to slide the outer cylinder with respect to the inner cylinder to align the holes on the inner and outer cylinder and permit air flow through the aligned holes. At the same time, the deflecting mechanism is moved from a position in which the barrel opening is opened, to a position in which the barrel opening is substantially closed by the deflecting mechanism. Thus, in the second mode air is deflected by the deflecting mechanism towards the aligned holes of the inner and outer cylinder.

7 Claims, 6 Drawing Sheets

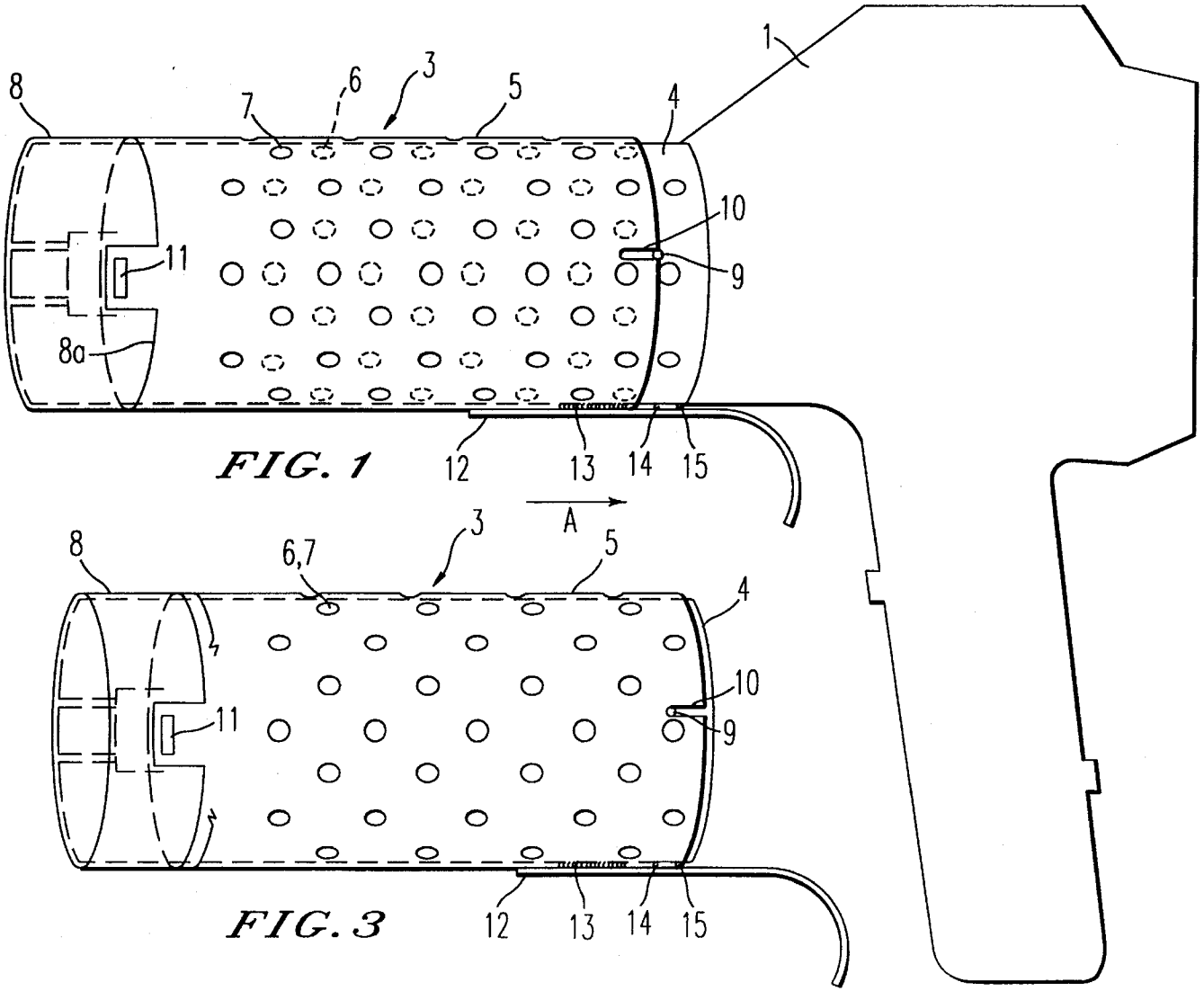
FIG. 1
FIG. 3
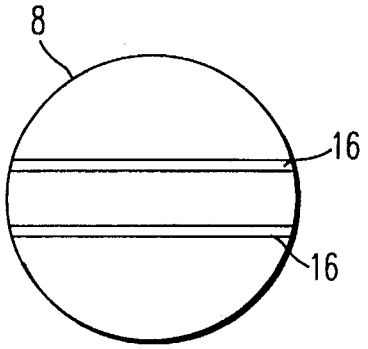
FIG. 2
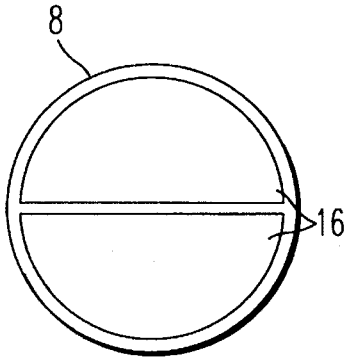
FIG. 4

HAND HELD BLOW DRYER HAVING AIRFLOW CONTROL MEANS

The present invention is related to Disclosure Document No. 380340 filed under the Disclosure Document Program of the U.S. Patent and Trademark Office.

BACKGROUND OF THE INVENTION

1. Field of the Invention

The present invention provides for an enhancement to a professional hair dressing blow dryer, more specifically to the blow dryer's barrel which permits variable airflow and saves energy.

2. Discussion of the Related Art

Conventional hair dressing "pistol-type" blow dryers utilize a one-directional airflow through a front opening of a cylindrical conduit or barrel of the blow dryer. Commercial attachments which are available to fit over the barrel opening to vary airflow require a two-handed operation.

U.S. Pat. No. 4,097,722 describes a mechanism for varying airflow by controlling an area of the barrel opening by a deflector which is activated by the trigger. However, this patent does not disclose airflow from the barrel surface itself.

U.S. Pat. No. 4,232,454 controls airflow from the barrel opening by the use of trap doors activated by a knob and a screw. This has a drawback in that it also requires a two-handed operation.

U.S. Pat. No. 5,157,757 describes variations of airflow, including secondary outlets on a barrel. However, this device like the remaining devices requires a two-handed operation, since full activation depends upon manual rotation of a collar, manual settings, as well as a trigger-operated baffle to vary the barrel opening.

During hair styling utilizing a blow dryer, hair dressers use the blow dryer in one hand and point the barrel opening at the hair to be styled. A brush or other styling tool is utilized in the other hand. Additionally, when blow styling medium to long length hair, hair dressers use the barrel horizontally with the barrel opening pointed away from the head, to lift hair for the subsequent insertion of the tool in the other hand. During this function, air flow from the barrel opening is wasted, and the barrel itself affords no benefit of any drying/styling capability.

Thus, conventional blow dryer devices do not provide for a barrel arrangement in which air can be directed through the barrel surface of the blow dryer. Additionally, conventional blow dryer devices do not provide for an efficient mechanism which permits a user to deflect air flow from the opening of the barrel, and simultaneously direct air flow through the barrel surface of the blow dryer by using a simple one-handed operation.

SUMMARY OF THE INVENTION

The present invention therefore provides for a blow dryer arrangement which overcomes the drawbacks of conventional arrangements discussed above.

The blow dryer arrangement of the present invention adds functionality to the blow dryer by varying airflow from the barrel surface, while conserving energy use. This permits the blow dryer of the present invention to be utilized for horizontal lifting/drying/styling, as well as a hot roller and diffuser.

The blow dryer arrangement of the present invention incorporates holes on the barrel surface and flaps at the barrel opening. By pulling on a trigger, the holes on the barrel are exposed, and at the same time, flaps at the barrel opening close down most of the airflow. This effects airflow from holes on the barrel, as well as some diffused air from the front opening.

The present invention therefore provides for a hand held blow dryer which comprises a body comprising a barrel having a barrel opening, the barrel comprising inner and outer cylinders having a plurality of holes, the outer cylinder being slidably mounted on the inner cylinder; pivotable deflecting means positioned at the barrel opening which is pivotable between an open position in which the barrel opening is opened and a deflecting position in which the barrel opening is substantially closed by the deflecting means; and actuation means operationally connected to the outer cylinder and operationally associated with the pivotable deflecting means for moving the deflecting means and the outer cylinder between a first position in which the holes on the inner and outer cylinders are not aligned and the pivotable deflecting means is in the open position, and a second position in which the holes on the inner and outer cylinders are aligned and the pivotable deflecting means is in the deflecting position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a view of the blow dryer and barrel assembly of the present invention in a first position in which the holes of the inner and outer cylinders of the barrel are not aligned;

FIG. 2 is a front view of the barrel opening of the blow dryer of FIG. 1 in the first position showing the flaps or deflecting means in an opened position;

FIG. 3 is a view of the inner and outer cylinders of the barrel of the blow dryer in a second position in which the holes of the inner and outer cylinders are aligned;

FIG. 4 is a front view of the barrel opening when the inner and outer cylinders are aligned as shown in FIG. 3, in which the flaps or deflecting means substantially close the barrel opening;

DESCRIPTION OF THE PREFERRED EMBODIMENTS

Figure 5:
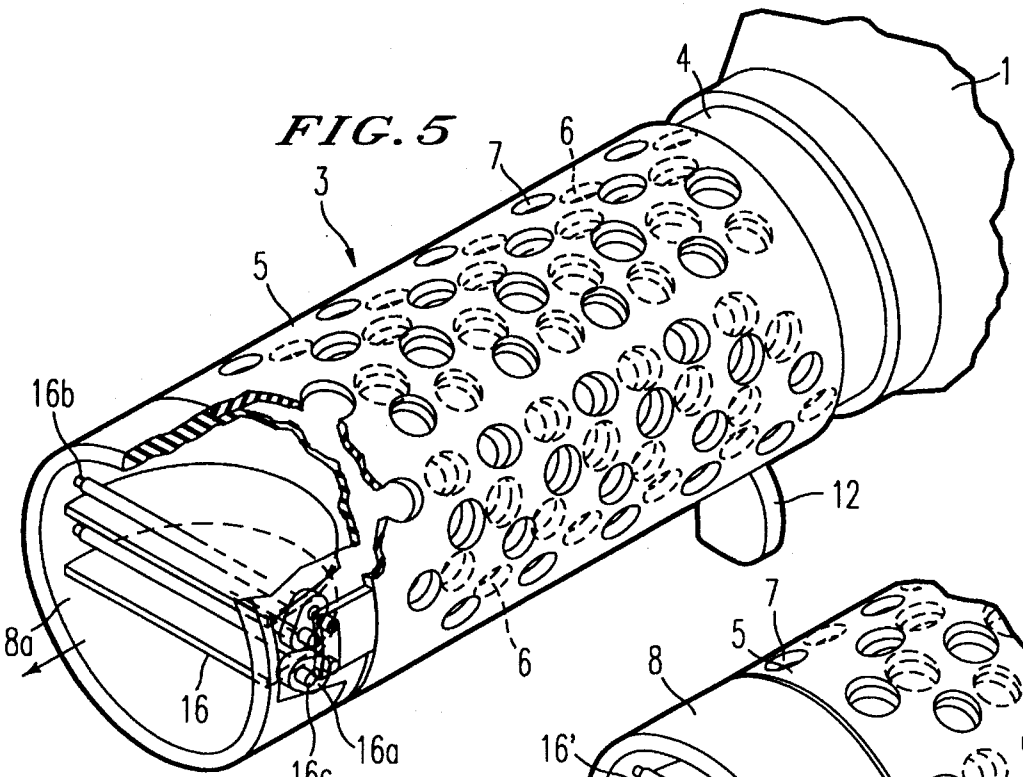
FIG. 5 is a perspective view of the inner and outer cylinders of the barrel and the flaps or deflecting means in the first position of FIGS. 1 and 2.

Referring now to the drawings, wherein like reference numerals designate identical or corresponding parts throughout the several views, and more particularly to FIGS. 1 and 5 thereof, FIG. 1 is a first view of the blow dryer assembly of the present invention while FIG. 5 is a perspective view. In FIGS. 1 and 5, the blow dryer includes a body 1 having a barrel 3. The barrel 3 includes an inner cylinder 4 and an outer cylinder 5 concentric with the inner cylinder 4. The outer cylinder 5 is slidably mounted on the inner cylinder 4. Each of the inner and outer cylinders (4, 5) includes a plurality of holes (6, 7) thereon (holes 6 on inner cylinder 4 and holes 7 on outer cylinder 5).

Figure 6:
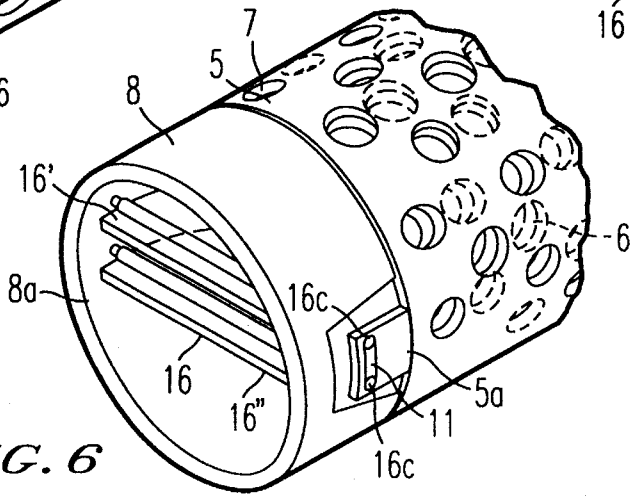
FIG. 6 is a perspective view of the flaps in an opened position as illustrated in FIG. 5.

As further illustrated in FIGS. 1 and 6, the blow dryer assembly also includes a cap 8 which covers a pivotable flap mechanism 16. The cap 8 and pivotable flap mechanism 16 are positioned at the barrel opening 8*a*. The cap 8 in FIG. 6 shows a cut-out opening, however, it is recognized that the cap 8 can completely cover all the moving mechanisms including the pivotable flap mechanism 16 at the front of the barrel.

FIGS. 1, 5 and 6 illustrate a first position of the outer cylinder 5 with respect to inner cylinder 4 in which the holes 7 on the outer cylinder 5 are not aligned with the holes 6 of the inner cylinder 4. In the position illustrated in FIGS. 1, 5 and 6, the pivotable flap mechanism 16 is positioned as illustrated in FIGS. 2, 5, 6 and 8. Therefore, any air flow through the barrel 3 will flow out of the barrel opening 8*a*. The non-aligned holes 6 and 7 of the inner and outer cylinders 4, 5 will block any air flow through the surface of the barrel 3.

Figure 7:
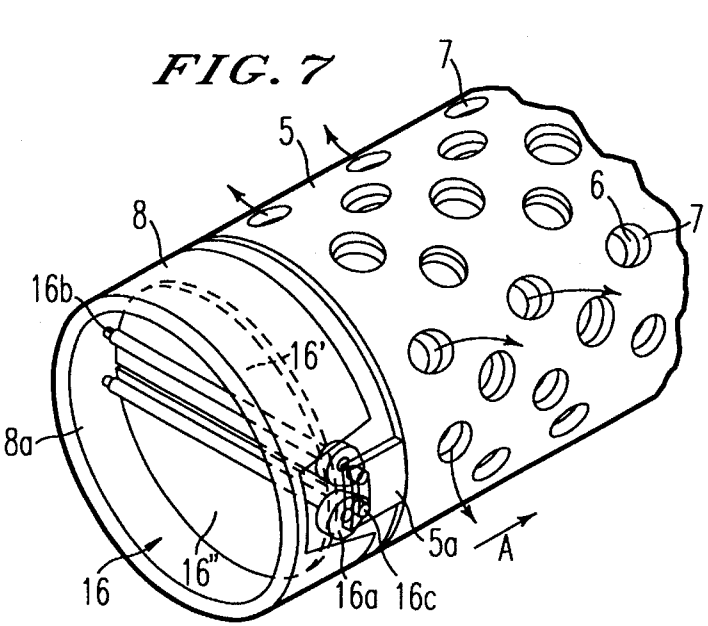
FIG. 7 is a perspective view of the flaps and the inner and outer cylinders in the second position of FIGS. 3 and 4.

In the position illustrated in FIGS. 3 and 7 the inner and outer cylinders 4, 5 are aligned so as to align the respective holes 6, 7 of the inner and outer cylinders 4, 5. In the position illustrated in FIGS. 3 and 7, the flap mechanism 16 is positioned as illustrated in FIGS. 4 and 7. That is, the flap mechanism 16 is positioned so as to substantially cover the barrel opening 8*a* as illustrated in FIGS. 4 and 7. It is noted that the movement of the inner and outer cylinders 4, 5 with respect to each other is coordinated with the movement of the flap mechanism 16 so as to achieve the positioning of the flap mechanism 16 as noted above. In this position, the flap mechanism 16 will deflect most of the air flow so as to direct air flow to the aligned holes 6 and 7 of the inner and outer cylinders 4, 5. Thus, air will be discharged through the surface of the barrel 3.

Figure 8:
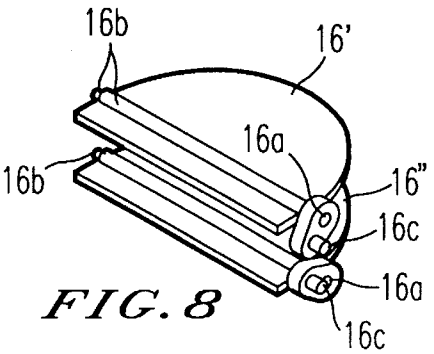
FIG. 8 shows the flaps in isolation.

A mechanism for achieving the above-noted movement of the inner and outer cylinders 4, 5 and the flap mechanism 16 will now be described. As illustrated in FIGS. 5–8, as well as FIGS. 9(*b*) and 11(*a*)–11(*c*), the pivotable flap mechanism 16 includes first and second flaps 16', 16" having mounting axles 16*b* and mounting pins 16*c* extending therefrom. The mounting pins 16*c* are mounted in an offset manner on an oval activator 16*a* as illustrated in FIG. 8. The present invention can also utilize washers 16*d* (FIG. (9) and 11(*a*)–11(*c*)) at the mounting pins 16*c* to permit a smooth operation. The pivotable flap mechanism 16 with the mounting pins 16*c* are mounted at the barrel opening 8(*a*) as follows: the mounting axles 16*b* and pins 16*c* are mounted so as to be inserted into elongated slots 17 on the inner cylinder 4 and elongated slots 11 on the outer cylinder 5 (see FIG. 5, FIG. 9(*a*) and FIG. 10). The slot 11 on the outer cylinder 5 is positioned on a protruding portion 5*a* of the outer cylinder 5. Thus, a movement of the outer cylinder 5 in the direction of the arrow A (FIGS. 1 and 7) will cause a movement of the pivotable flap mechanism 16 from the position illustrated in FIG. 5 in which the barrel opening 8*a* is opened, to a position illustrated in FIG. 7 in which the barrel opening 8*a* is substantially closed. This is due to the fact that the movement of the outer cylinder 5 in the direction A will cause the pins 16*c* of the pivotable flap mechanism 16 to rotate with the oval actuator 16*a*, which will thereby cause the pivotable flap mechanism 16 to rotate to the substantially closed position.

Figure 10:
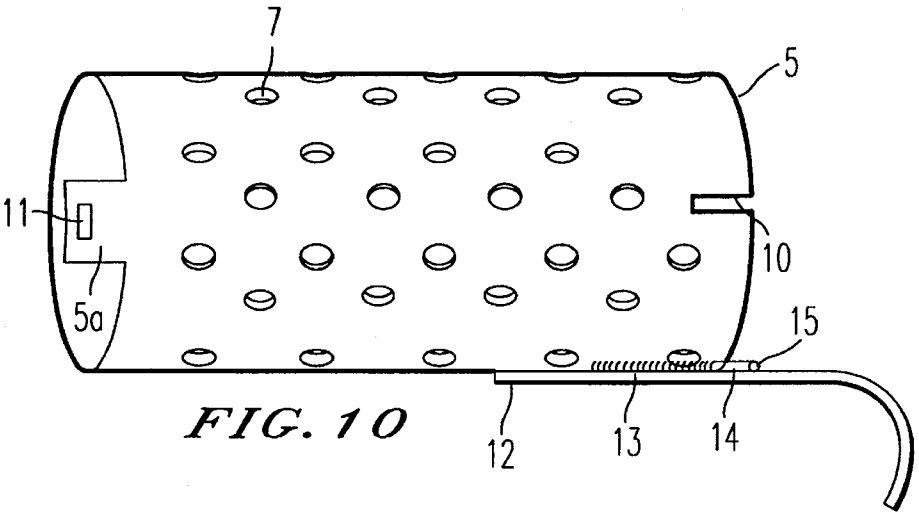
FIG. 10 shows the outer cylinder of the present invention.

The outer cylinder 5 includes a trigger mechanism 12 which is utilized to cause the sliding movement of the outer cylinder 5 with respect to the inner cylinder 4. The trigger mechanism 12 includes a spring 13 positioned in a slot 15 in the outer cylinder 5 which is guided by a pin 14 (FIGS. 1, 3, 10). The spring 13 urges the outer cylinder 5 in a direction opposite to direction A. Pulling the trigger in the direction A will cause the outer cylinder 5 to move in direction A which thereby causes the movement of the pivotable flap mechanism 16 from the position illustrated in FIG. 5 to the substantially closed position illustrated in FIG. 7. FIGS. 1, 3 and 10 show a single spring 13 positioned on a lower portion of the barrel assembly 3. It is noted, however, that the barrel assembly can also include two springs 13 positioned on diametrically opposed portions of the barrel assembly 3 to add stability to movement of the cylinders (4, 5).

At the same time, movement of the outer cylinder 5 in the direction A will also cause the holes 6, 7 of the inner and outer cylinders 4, 5 to be aligned with each other as illustrated in FIG. 7.

Therefore, in a first position (first mode) illustrated in FIGS. 1 and 5, the pivotable flap mechanism 16 is in the position illustrated in FIG. 5 to permit airflow through the barrel opening 8*a* and the holes on the inner and outer cylinders 4, 5 are not aligned (FIGS. 1 and 5) so as to block airflow through the surface of the barrel 3. This permits the user to use the blow dryer in a normal manner.

When the hair dresser desires to utilize the blow dryer for horizontal lifting/drying, styling, as a hot roller, as a diffuser, etc., the hair dresser pulls the trigger 12 in the direction A to position the outer cylinder 5 with respect to inner cylinder 4 in the manner illustrated in FIGS. 3 and 7 (second mode). This will cause the holes 6, 7 on the inner and outer cylinders 4, 5 to be aligned, and will cause the flaps 16', 16" of the flap mechanism 16 to pivot to the position illustrated in FIG. 7 so to substantially close the barrel opening 8*a* In this position, the flaps 16', 16" will deflect air towards the aligned holes 6, 7 exposed on the barrel, and some diffused air will flow through the barrel opening 8*a*.

Figure 9A:
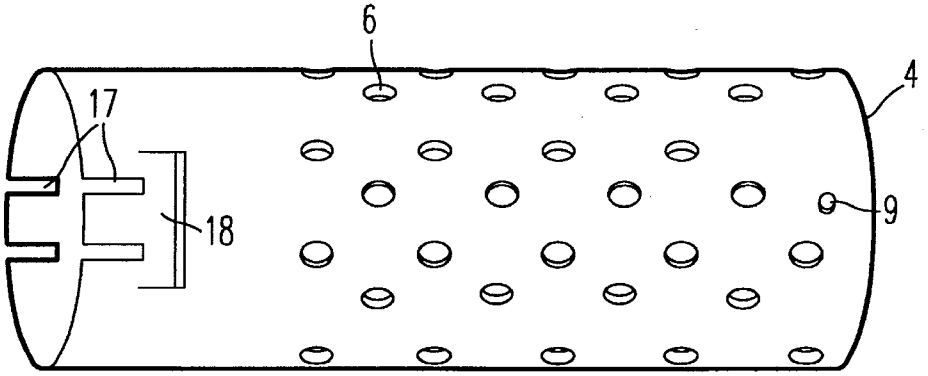
FIGS. 9(*a*), 9(*b*) and 9(*c*) respectively show the inner cylinder, flaps, and a cover for the barrel.
Figure 9B:
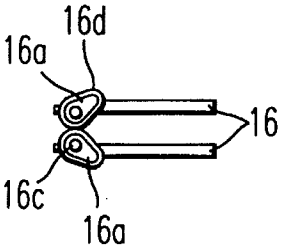
Figure 9C:
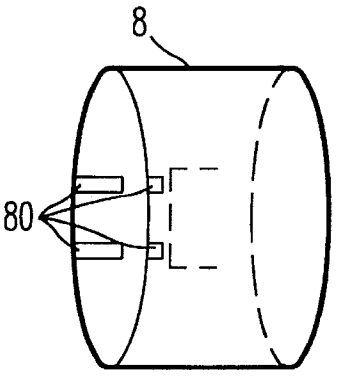
Figure 11A:
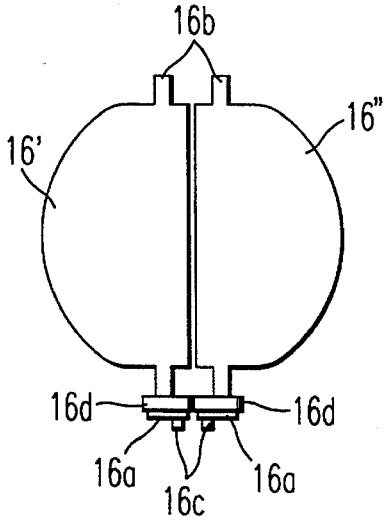
FIG. 11(*a*), 11(*b*) and 11(*c*) show different views of the flaps.
Figure 11B:
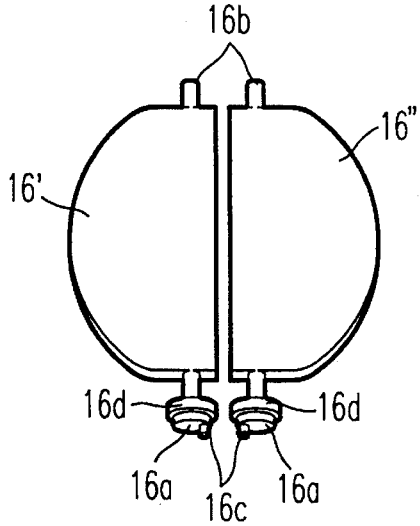
Figure 11C:
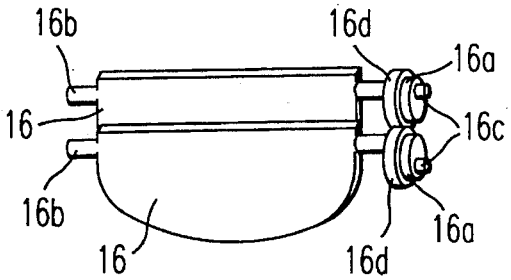

The amount of movement of the outer cylinder 5 with respect to the inner cylinder 4 can be determined by providing for an elongated slot 10 on the outer cylinder 5 and a pin 9 on the inner cylinder 4 as illustrated in FIGS. 1, 3, 9(*a*) and 10. When the barrel opening 8*a* is substantially closed by the flaps 16', 16" as illustrated in FIG. 7, the barrel opening 8*a* is not sealed tightly by the flaps 16', 16" so as to permit some air to be diffused from the barrel opening.

The present invention can also provide for the cap 8 illustrated in FIGS. 6 and 9(*c*) which can be utilized to cover the flap mechanism 16. The cap 8 shows a cut-away portion to illustrate the side of the flap mechanism 16. It is recognized that the cap 8 can completely surround the circumferential front of the barrel. The cap 8 also can include stops 80 (FIG. 9(*c*)) such that the cap 8 fits over the outer cylinder 5 and includes cooperating holes which permit the insertion of the axles 16*b* and pins 16*c* of the flap mechanism 16.

Figure 12:
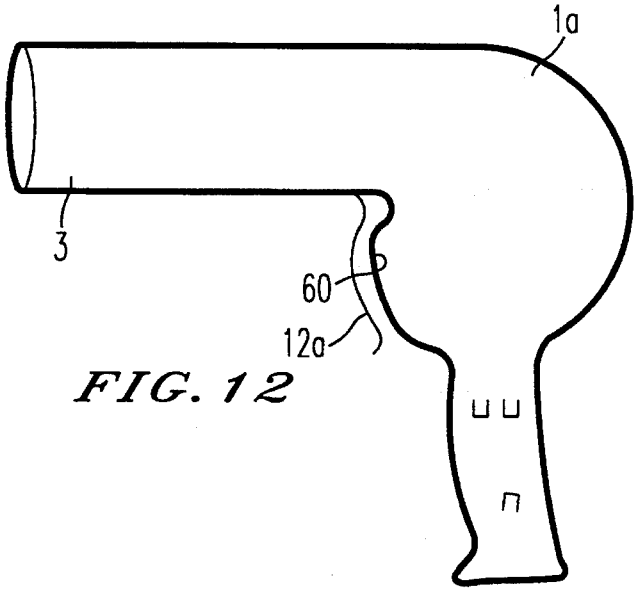
FIG. 12 shows a different blow dryer body embodiment.

The blow dryer arrangement of the present invention can also be utilized on a blow dryer 1*a* having a belly type curve 60 in the motor housing as illustrated in FIG. 12. In this case the trigger 12*a* would have a curve which matches the curve of the housing. This embodiment would operate in the same manner as the embodiment discussed above.

Additionally, the trigger mechanism 12 of the present invention can be operationally associated with a control mechanism 50 (FIG. 13) which coordinates the actuation of the trigger 12 with temperature settings of a blow dryer. For example, a conventional blow dryer includes low, medium and high settings. The trigger mechanism 12 of the present invention can be operationally associated with a control mechanism 50 such as illustrated in FIG. 13 to lower a high temperature setting of a blow dryer to a temperature setting which is lower than the high temperature setting when the trigger 12 is actuated.

Figure 13:
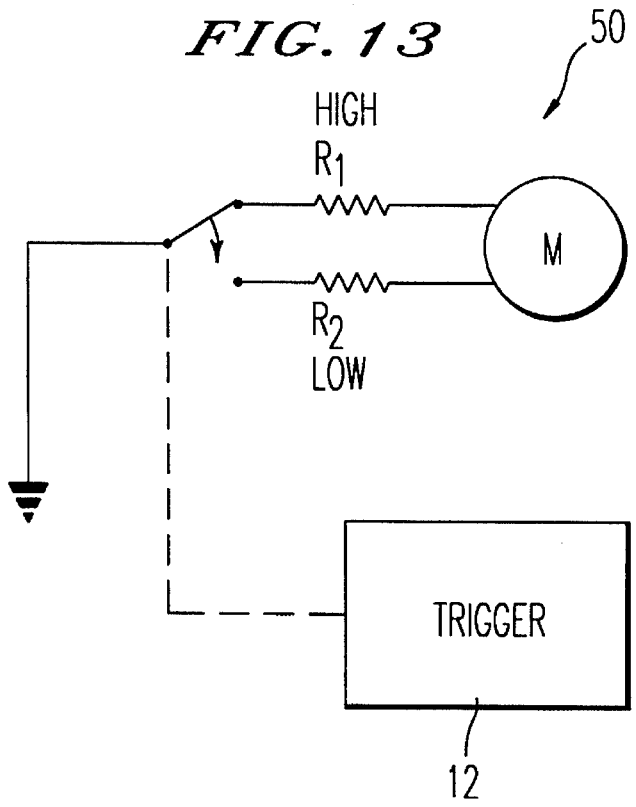
FIG. 13 shows a circuit arrangement for controlling temperature settings for the blow dryer of the present invention.

As illustrated in FIG. 13, the positioning of the trigger 12 in the first position (FIGS. 1 and 5) in which the holes 6, 7 are not aligned and the air flow is through the front opening 8*a* of the barrel can permit the hair dryer setting to be set at the high temperature setting ($R_1$) of a blow dryer. Movement of the trigger 12 to the second position (FIGS. 3 and 7) in which the holes 6, 7 are aligned and the front opening 8*a* is substantially closed, can cause the dryer setting to be positioned in a temperature setting ($R_2$) which is lower than the high temperature setting of a blow dryer. The explanation given above has been given for the situation when the blow dryer is in the high temperature setting when the trigger is actuated. It is recognized that the control mechanism 50 can be designed so as to not lower the temperature if upon the actuation of the trigger 12, the blow dryer is set at the medium or low temperature settings. However, the lowering of the temperature setting of the blow dryer when the trigger 12 is actuated, is based on design considerations and the desired temperature which would be preferable when the trigger 12 is actuated. It is further recognized that the blow dryer could include an additional trigger mechanism which is not associated with the actuation of the trigger 12 so as to permit the user to selectively lower the temperature from a high temperature to a temperature lower than the high temperature.

Figure 14:
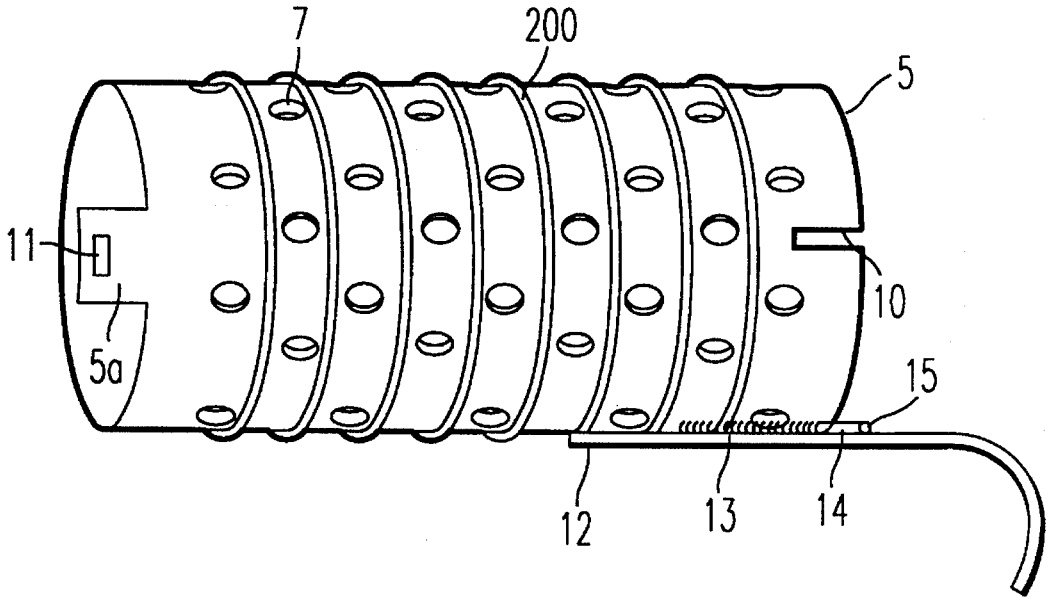
FIG. 14 shows a modification of the barrel assembly of the present invention.

FIG. 14 shows a further embodiment of the barrel 3 in which the barrel 3 includes rings 200 that are spaced along the length of the barrel 3, are affixed to the periphery of nhe outer cylinder 5 and extend around the circumference of the outer cylinder 5. The rings 200 serve the guide hair when the barrel assembly is positioned against hair. The rings 200 are aligned so as to not obstruct air flow from the holes (6, 7).

Figure 15:
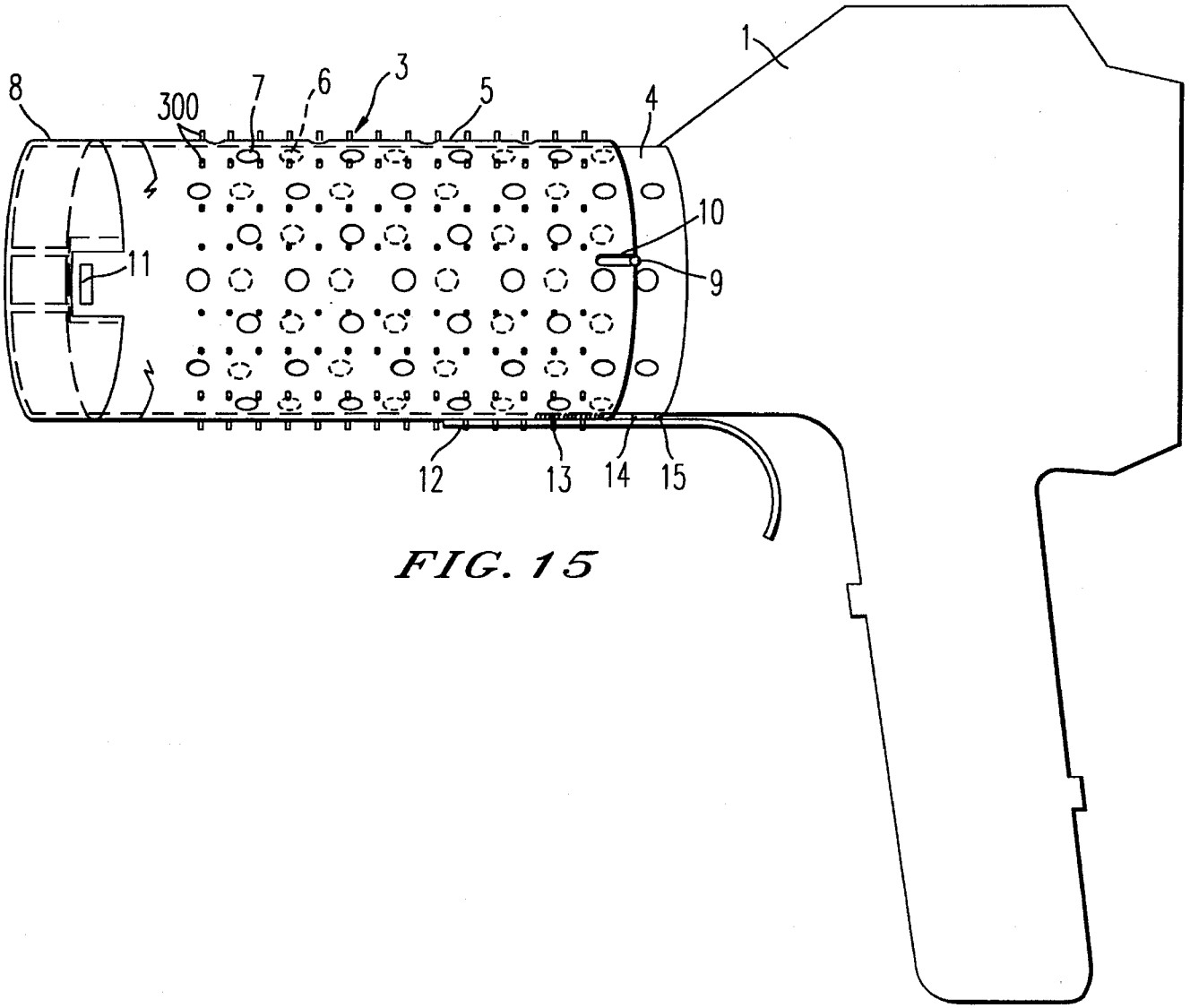
FIG. 15 shows a further modification of the barrel assembly of the present invention.

FIG. 15 shows a further embodiment of the barrel 3 in which the barrel 3 can include bristles or teeth 300 spaced between the holes 7 of the barrel as illustrated in the figure so as to extend in a row between the holes 7. The bristles or teeth 300 can extend around the periphery of the barrel 3 and can be utilized for further styling enhancement.

Thus, the blow dryer of the present invention maximizes the blow dryer's capability by incorporating multiple functions in one tool. It thereby provides a hair dresser or stylist with a wide range of airflow use by utilizing a single tool that is operated by one hand. That is, by simply pulling on the trigger 12, the hair dresser can vary the air flow through the barrel. Any desired attachments can be fitted over the barrel of the present invention just as with current blow dryers, and used whether or not the trigger is operated. The blow dryer of the present invention can also be used as a large hot roller, and it has some diffusing capabilities from the barrel opening when the trigger is operated.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A hand held blow dryer comprising:

a body comprising a barrel having a barrel opening, said barrel comprising inner and outer cylinders each having a plurality of holes, said outer cylinder being slidably mounted on said inner cylinder;

pivotable deflecting means positioned at said barrel opening which is pivotable between an opened position in which said barrel opening is opened, and a deflecting position in which said barrel opening is substantially closed by the deflecting means; and actuation means operationally connected to said outer cylinder and operationally associated with said deflecting means for moving said deflecting means and outer cylinder between a first position in which said holes on said inner and outer cylinders are not aligned and said pivotable deflecting means is in said open position, and a second position in which said holes on said inner and outer cylinders are aligned and said pivotable deflecting means is in said deflecting position.

2. A hand held blow dryer comprising:

a body comprising a barrel having a barrel opening for directing air towards hair to be styled, said barrel comprising an inner cylinder and an outer cylinder concentric to said inner cylinder and slidably mounted on said inner cylinder, an outer surface of each of said inner and outer cylinders comprising a plurality of holes;

pivotable flap means mounted at said barrel opening, said pivotable flap means being pivotable between a first flap position in which said barrel opening is opened, and a second flap position in which said barrel opening is substantially closed; and actuation means operationally connected with said outer cylinder and operationally associated with said pivotable flap means for causing a sliding movement of said outer cylinder with respect to said inner cylinder and a pivoting of said pivotable flap means, wherein a movement of said actuation means causes a movement of said outer cylinder and a pivoting of said pivotable flap means between a first position in which the holes on said inner cylinder are not aligned with the holes on the outer cylinder and said pivotable flap means is in said first flap position, and a second position in which the holes on the inner cylinder are aligned with the holes on the outer cylinder and the pivotable flap means is in said second flap position to substantially close said barrel opening.

3. A dryer according to claim 2, wherein said inner cylinder comprises a protruding stop which cooperates with a slot in said outer cylinder which defines an amount of sliding movement of the outer cylinder with respect to said inner cylinder.

4. A dryer according to claim 2, wherein said pivotable flap means comprise first and second flaps, each of said first and second flaps comprise oval activators with pins positioned therein, said pins extending through corresponding elongated slots in said inner and outer cylinders so as to pivotally mount the first and second flaps at said barrel opening, wherein movement of the outer cylinder from said first position to said second position pulls the pins of said first and second flaps along the elongated slot of the inner cylinder to cause a rotation of the pins and the oval activators and thereby cause a rotation of the first and second flaps to substantially close said barrel opening.

5. A dryer according to claim 2, wherein said actuation means is a trigger positioned on said outer cylinder, said trigger comprising at least one spring positioned in a slot on said outer cylinder, said spring urging said outer cylinder to said first position and said trigger permitting a sliding movement of said outer cylinder to said second position against an urging force of the spring.

6. A dryer according to claim 2, further comprising means operationally connected to said actuation means for changing between a high temperature setting of said dryer and a temperature setting lower than the high temperature setting in response to a movement of said actuation means.

7. A dryer according to claim 2, wherein said outer cylinder comprises rings which are spaced along a length of said outer cylinder and extend around a circumference of said outer cylinder for guiding hair, said rings being positioned so as to not obstruct air flow through said holes.

* * * * *